US005827001A

United States Patent [19]

Taghavi-Khanghah

[11] Patent Number: 5,827,001

[45] Date of Patent: Oct. 27, 1998

[54] BRUSH HAVING DISPLACEMENT MEMBER FORCING MATERIAL INTO BRISTLES

[75] Inventor: Said Taghavi-Khanghah, Newcastle Upon Tyne, England

[73] Assignee: Veresk Biosystems Ltd., Great Britain

[21] Appl. No.: 617,893

[22] PCT Filed: Sep. 21, 1994

[86] PCT No.: PCT/GB94/02046

§ 371 Date: Mar. 19, 1996

§ 102(e) Date: Mar. 19, 1996

[87] PCT Pub. No.: WO95/08282

PCT Pub. Date: Mar. 30, 1995

[30] Foreign Application Priority Data

Sep. 23, 1993 [GB] United Kingdom ..... 9319686

[51] Int. Cl.[6] ..... A45D 40/00; A46B 11/02

[52] U.S. Cl. ..... 401/145; 401/156; 401/169; 401/176; 401/184; 401/280

[58] Field of Search ..... 401/145, 156, 401/158, 162, 169, 176, 181, 183–5, 280, 283, 291

[56] References Cited

U.S. PATENT DOCUMENTS

| | | | |
|---|---|---|---|
| 1,615,999 | 2/1927 | Perelman | 401/155 |
| 2,823,401 | 2/1958 | O'Higgins | 401/280 |
| 3,864,047 | 2/1975 | Sherrod | 401/186 X |
| 5,158,383 | 10/1992 | Glover et al. | 401/176 X |
| 5,346,324 | 9/1994 | Kuo | 401/176 X |
| 5,382,106 | 1/1995 | Voigt | 401/169 X |

*Primary Examiner*—Danton D. DeMille
*Attorney, Agent, or Firm*—Larson & Taylor

[57] ABSTRACT

A brush, in particular a toothbrush, comprises a head (20) including a plurality of bristles (24) thereon and having at least one opening (26) therein feeding to the bristles (24), a container (2) of paste (4) connected to the head (20), and a control member (32, 50) within the brush movable between a first position in which the or each opening (26) in the head (20) is closed thereby, and a second position in which the or each opening (26) is open, the movement of the control member (32, 50) from the first position to the second position resulting in flow of paste (4) from the container (2) through the or each opening (26) in the head (20) and onto the bristles (24) of the brush.

12 Claims, 3 Drawing Sheets

BRUSH HAVING DISPLACEMENT MEMBER FORCING MATERIAL INTO BRISTLES

TECHNICAL FIELD

This invention relates to brushes, and has particular, though not exclusive, application to toothbrushes.

BACKGROUND ART

Current toothbrushes are commonly one of two different types. The first type requires the user to dispense a quantity of toothpaste from a tube or container onto the bristles of the toothbrush. Such an arrangement requires the provision of separate containers and toothbrushes, and the step of charging the toothbrush with toothpaste from the container prior to use, which can be a messy and time-consuming operation.

The second type of toothbrush incorporates its own container of toothpaste, usually in or as the handle of the toothbrush. The container, once empty, can either be refilled or replaced. However, such arrangements suffer from a number of disadvantages, not the least of which is that the overall toothbrush is of relatively complex construction and is therefore expensive to manufacture, operation of the toothbrush requiring the actuation and/or manipulation of several different elements within the system.

For example, it is known from U.S. Pat. No. 4,615,635 to provide a toothbrush incorporating a flow control mechanism for the toothpaste and which includes a head having an opening feeding into the bristles, and a slide member movable longitudinally of the brush relative to the head and carrying on its end a plug which can open or close the opening in the head whereby paste from a container connected to the head can be manually squeezed from an associated flexible container through the opening when open and onto the bristles.

However, the provision of a single opening of this nature within the head of the brush does not result in an even distribution of the paste along the bristles, while the plug, being of a bulbous shape and located above the opening, constitutes an uneven surface within the bristles that can be uncomfortable to the user. Additionally, the requirement to squeeze the container makes the brush itself uncomfortable to hold and use.

Further, use of the toothbrush involves the separate actions of moving the slide member to release the opening, and thereafter manually extruding the paste onto the bristles.

DISCLOSURE OF THE INVENTION

It would be desirable to be able to provide a toothbrush which overcame the aforementioned disadvantages, and in particular which was of relatively compact construction, simple to operate and hygienic in use.

According to the present invention there is provided a brush comprising a head including a plurality of bristles thereon, at least one opening in the head feeding to said bristles, a container of paste connected to said head, and a control member within the brush movable between a first position in which the or each opening in the head is closed thereby and a second position in which the or each opening is open, characterised in that movement of the control member from the first position to the second position results in the extrusion of paste from the container through the or each opening in the head and onto the bristles of the brush.

Thus it will be appreciated that such an arrangement eliminates the necessity for the user manually to squeeze the paste from the container onto the bristles after the opening in the head has been opened, the single movement of the control member serving the dual purpose of releasing the opening from its closed condition and charging the bristles with paste.

In a preferred embodiment of the invention, the head of the brush comprises a base plate upstanding from which are said bristles, a plurality of openings being formed in said base plate, the control member including a first end extent positioned below said base plate of the head and having a corresponding plurality of apertures therethrough for alignment with said openings in the head on sliding movement of the control member from its first position to its second position.

Conveniently, the other end extent of the control member co-operates with the container in such a manner that said sliding movement thereof releases paste from the container which flows from the container through the aligned openings and apertures.

In one embodiment of the invention, the container comprises a sealed housing bounded by a diaphragm, movement of the control member from its first position to its second position displacing said diaphragm whereby paste is pumped from the housing to the head of the brush.

In an alternative embodiment of the invention, the container comprises a pressurised housing provided with a release valve thereon, movement of the control member from its first position to its second position opening said valve whereby paste is released under pressure from the housing and flows to the head of the brush.

The control member may comprise an elongate slider extending between the container and the head, a passageway within the brush feeding from the container to the plurality of openings within the first end extent of the control member.

Alternatively the control member may be hollow and may incorporate therein a passageway feeding from the container to the plurality of openings in the first end extent thereof.

The container may comprise, or be incorporated in, the handle of the brush, while said handle may be integral with or detachable from the head of the brush.

Preferably the control member includes an operating button projecting from the brush movement of which effects said movement of the control member.

Conveniently the base plate and attached bristles of the brush comprise a component removable from the brush, whereby said bristles can be replaced as required.

DETAILED DESCRIPTION OF PREFERRED EMBODIMENTS

Figure 1:
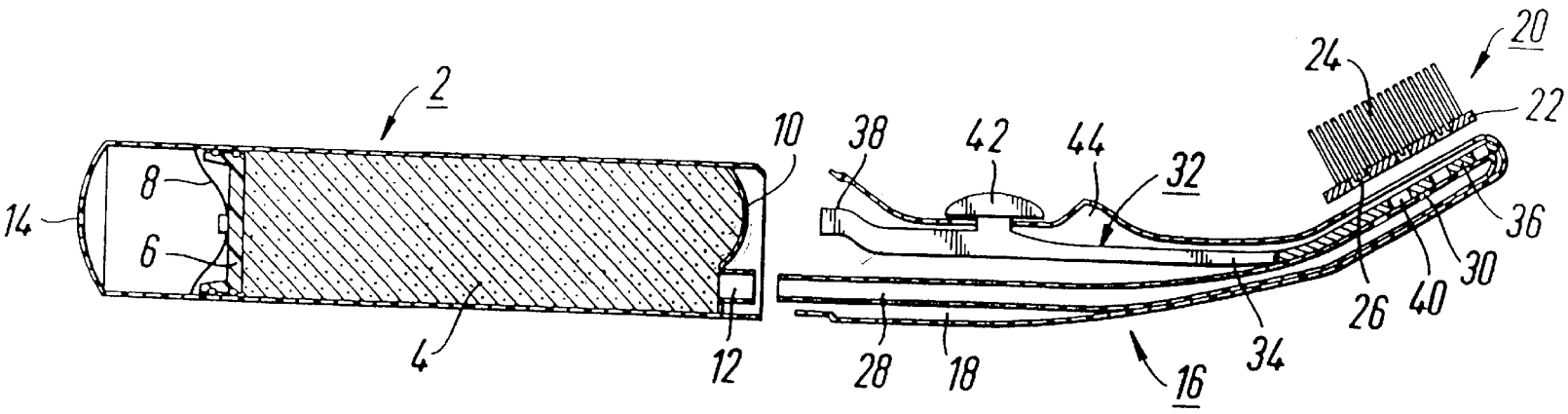
FIG. 1 is an exploded section through a first toothbrush according to the invention.
Figure 2:
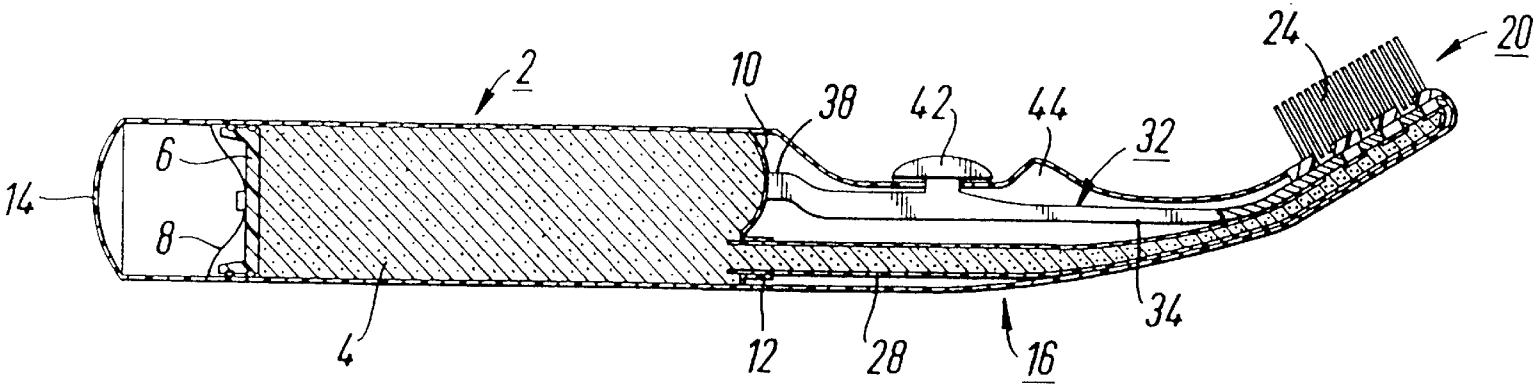
FIGS. 2 and 3 are sections through the toothbrush of FIG. 1 with the control member in its closed and open positions respectively.
Figure 3:
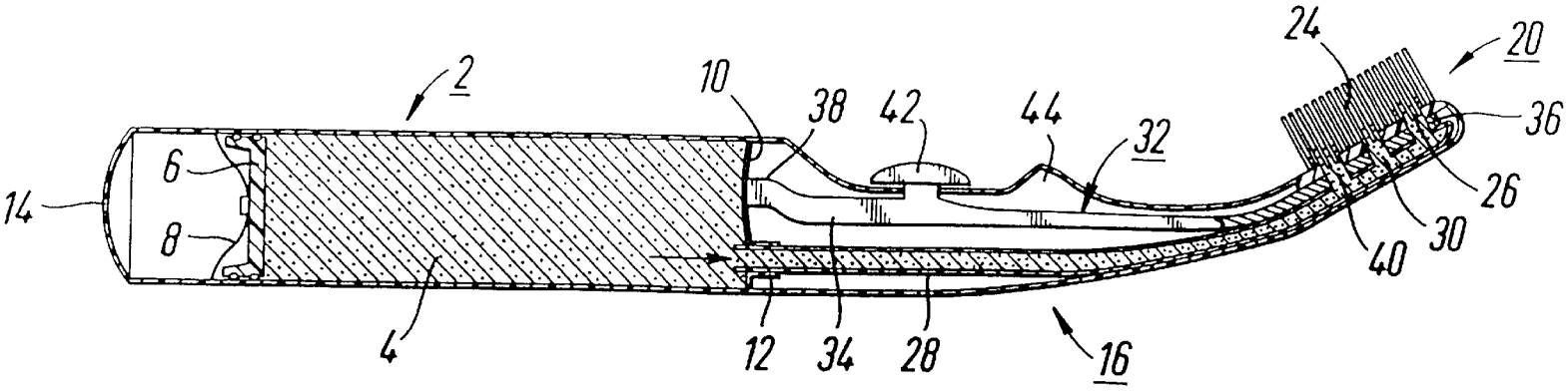

Referring to FIGS. 1 to 3 there is illustrated a toothbrush including a handle in the form of a cartridge indicated generally at 2 containing toothpaste 4, the cartridge incorporating in one end thereof a piston 6 and a spring 8, the other end of the cartridge 2 being closed by means of a flexible, outwardly-convex displacement member or diaphragm 10. Spring 8 prevents return of piston 6 to the left, as viewed in the drawings, when pressure is applied to piston 6 by the paste on depression of diaphragm 10. A sealed outlet 12 is provided in said other end of the cartridge 2, and an air bleed hole 14 is provided in said one end of the cartridge 2.

The body of the toothbrush is indicated generally at 16 and includes a hollow body portion 18 of a plastics material one end of which is, for example, a snap-fit or a screw-fit onto the cartridge 2.

The end of the body portion 18 remote from the cartridge 2 provides a mounting for a removable head 20 which includes a base plate 22 upstanding from which are a plurality of bristles 24 and through which are formed a plurality of apertures 26 for reasons which will become apparent.

Mounted within the body portion 18 is a delivery tube 28 one end of which projects slightly from the one end of the body portion 18 and the other end of which is positioned below the base plate 22 of the head 20 and has a plurality of apertures 30 therein aligned with the apertures 26 in the base plate 22.

A control member for the toothbrush is indicated generally at 32 and comprises an elongate slider 34 a first end extent 36 of which is positioned between the base plate 22 of the head 20 and the other end of the delivering tube 28, and the other end extent 38 of which lies adjacent the one end of the delivery tube 28. Said first end extent 36 of the slider 34 has a plurality of apertures 40 formed therethrough at the same spacing as the apertures 26, 30.

Integrally formed with the slider 34 is an operating button 42 located externally of the body 16 and extending through an elongate slot in said body 16 to permit longitudinal movement of the slider 34 relative to the body 16 between a first position shown in FIGS. 1 and 2 in which the apertures 40 in the first end extent 36 of the slider 34 are misaligned with the apertures 26 in the base plate 22 and the apertures 30 in the other end of the delivery tube, whereby the first end extent 36 of the slider 34 prevents communication between corresponding ones of said apertures 26, 30, and a second position shown in FIG. 3 in which the corresponding apertures 26, 30, 40 in the base plate 22, delivery tube 28 and slider 34 are aligned.

The components 2, 16 of the toothbrush are assembled with the slider 34 in its first position. On assembly, the one end of the delivery tube 28 punctures the seal in the outlet 12 from the cartridge 2 to establish communication between the delivery tube 28 and the paste 4. The piston 6 urges paste from the cartridge 2 along said tube 28 to the other end thereof as shown in FIG. 2, the first end extent 36 of the slider 34 preventing flow of paste through the apertures 30 in the other end of the tube 28. The toothbrush is primed for use with the other end extent 38 of the slider 34 abutting the diaphragm 10.

In order to use the toothbrush, the user moves the operating button 42 to the left as indicated by arrow A in FIG. 2 whereby the slider 34 is moved from its first position shown in FIGS. 1 and 2 to its second position shown in FIG. 3. This movement results in the other end extent 38 of the slider 34 depressing the diaphragm 10 whereby a quantity of paste 4 is pumped from the cartridge 2 through the delivery tube 28.

At the same time, the first end extent 36 of the slider 34 is moved to a position in which the apertures 40 therein are aligned with those in the delivery tube 28 and the base plate 22 of the head 20 so that paste 4 is pumped from the other end of the delivery tube 28 through the apertures 26 and onto the bristles 24 for use by the user.

Further paste as required can be fed to the head 20 by appropriate right and then left movement of the slider 34, the piston 6 constantly urging the paste 4 through the outlet 12. Once brushing is completed, the slider 34 is returned to its first position to close the apertures 26 to prevent contamination of the paste 4 and to avoid undesirable extrusion of paste 4 through said apertures 26.

Thus it will be appreciated that pumping of paste 4 from the cartridge 2 occurs simultaneously with opening of the apertures 26 in the head 20 by means of a single, longitudinal sliding movement of the control member 32, thereby eliminating the necessity for any manual squeezing or the like of the supply of paste.

This control member 32 may be other than illustrated and may be movable other than purely linearly, for example by pressing and sliding, providing movement thereof causes both extrusion of the paste 4 and opening of the apertures 26 either simultaneously or sequentially.

The external configuration of the body 16 is preferably such as to provide a thumb recess for the operating button 42, an upstand 44 separating the neck of the body that enters the user's mouth from the control area.

The control member 32 is conveniently of a flexible material such as polypropylene to enable the body 16 to be angled as shown without adversely affecting movement of the slider 34.

The overall thickness of the aligned base plate 22, the other end of the delivery tube 28 and the one end extent 36 of the slider 34 is relatively small compared with the equivalent region of established toothbrushes to provide more comfortable use than heretofore, while the location of the control member 32 remote from the head of the toothbrush provides for a more hygienic arrangement than heretofore.

The described toothbrush, as well as being user friendly, is of relatively simple construction and involves relatively low production costs.

The provision of a removable/replaceable head 20 enables the user readily to dispose of one head when it is worn out and replace it with another head 20 at considerably less cost than if the whole of the body 16 and head 20 had to be renewed.

Figure 6:
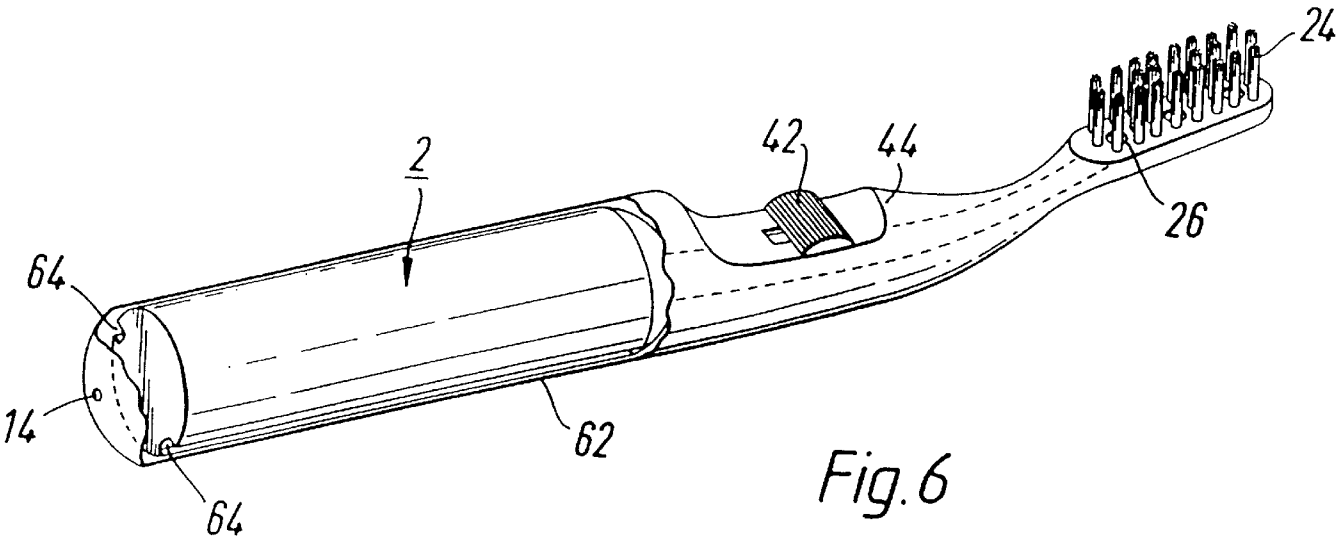
FIG. 6 is a perspective view, partly cut-away, of a toothbrush according to the invention.
Figure 4:
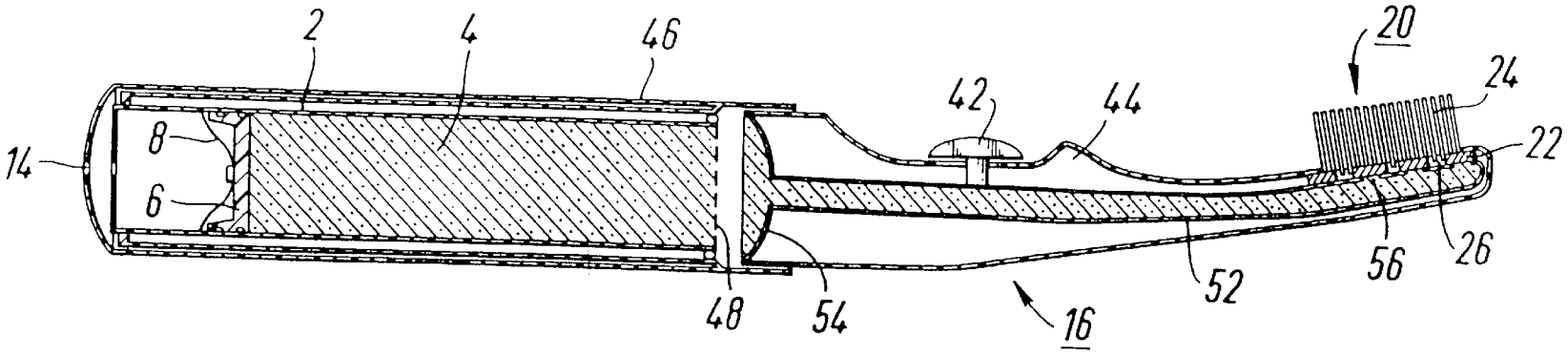
FIGS. 4 and 5 are sections through further toothbrushes according to the invention.
Figure 5:
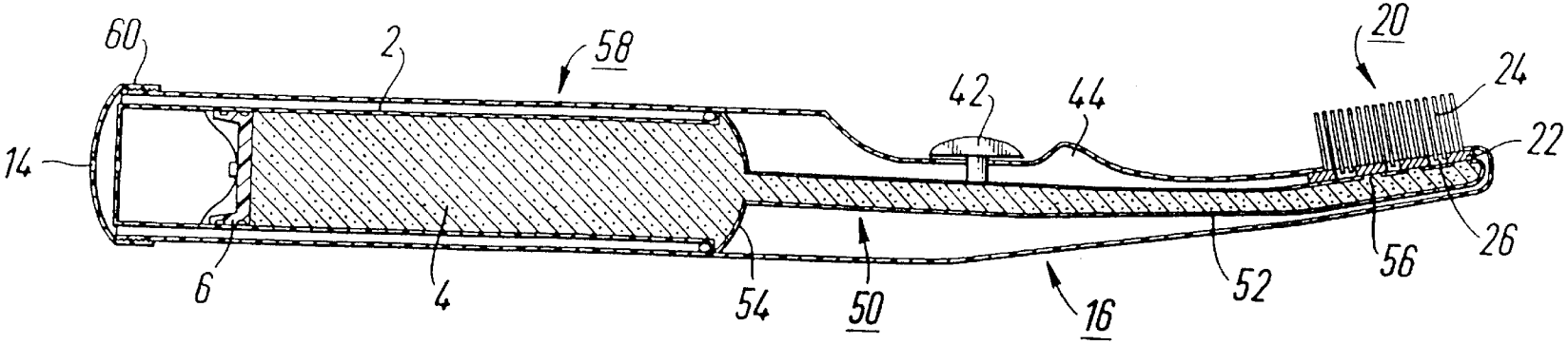

In the embodiments of FIGS. 4 to 6 components equivalent to those of FIGS. 1 to 3 are similarly referenced.

The toothbrush shown in FIG. 4 differs from that of FIGS. 1 to 3 primarily in that the delivery tube 28 and control member 32 are integrated into a single unit, and the cartridge 2 is housed within a container.

More particularly, the cartridge 2, which can be of relatively cheap material, is housed within an outer container 46 having a smooth finish and constituting a handle to the toothbrush, the end of the cartridge 2 remote from the piston 6 being closed by a removable seal 48.

The body 16 of the toothbrush incorporates a control member indicated generally at 50 and comprising a hollow deliver tube 52 one end of which carries a diaphragm 54 and the other end of which has a plurality of apertures 56 therethrough for alignment with the apertures 26 in the head 20.

Integrally formed with the tube 52 is an operating button 42 located externally of the body 16 as in the embodiment of FIGS. 1 to 3.

The toothbrush is assembled after removing the seal 48 from the cartridge 2, and operation thereof is similar to that described in relation to the embodiment of FIGS. 1 to 3. Sliding movement of the control member 50 to the left as viewed in FIG. 4 causes depression of the diaphragm 54 to pump paste 4 through the tube 52 to the apertures 56 which, by virtue of said movement, are aligned with the apertures 26.

By effectively integrating the control member and delivery tube of FIGS. 1 to 3, the embodiment of FIG. 4 enables a head 20 of even smaller thickness to be provided, thus making the toothbrush even more compact and user friendly.

FIG. 5 shows an embodiment similar to that of FIG. 4 but having a one-piece body 58 provided with a screw cap 60 over the open end thereof whereby a replacement cartridge 2 can be inserted into and removed from the body 58.

The perspective view of the toothbrush shown in FIG. 6 has part of the outer container 62 for the cartridge 2 broken away to reveal the cartridge 2, the inner wall of the container 62 being provided with longitudinal, diametrically-opposed tongues therealong for location in corresponding grooves 64 formed in the cartridge to position the cartridge accurately in said container.

The described toothbrushes are inherently user-friendly in view of their compact design and simple operation, being ideally suited to the mass market because of their convenience for day to day use, and also being appropriate for specialised niche markets such as travellers, armed forces personnel and physically handicapped persons.

Although described in relation to toothbrushes, it will be appreciated that the basic inventive concept has application to other types of brushes provided with containers for paste or other dispensable materials.

Modifications and variations can be made to the described embodiments without departing from the scope of the invention. For example, the control member 32 may be integral with, to be movable with, the upper part of the body 16, including the upstand 44, and the head 20 instead of being movable relative thereto, providing movement of the integral unit results in opening and closing of the apertures supplying toothpaste to the bristles 24. Further, the pump-type dispensing cartridges of paste may be replaced by pressurised containers from which paste is extruded under gas pressure on opening of an associated valve by means of the control member. Other such modifications and variations will be apparent to those skilled in the art.

What is claimed is:

1. A brush comprising a hollow body portion, a head mounted adjacent one end of said body portion and including a plurality of bristles thereon, at least one opening in the head feeding to said bristles, a container of paste connected to the other end of the body portion, said container having a piston at one end defining a lower limit of paste in the container, and a displacement member within the other end of the container defining an upper limit of paste within the container, movement of the displacement member towards the one end of the container causing feeding paste from the other end of the container through the hollow body portion towards the head, and a control means, mounted in said body portion and movable between a first position and a second position, such that when said control means moves from said first position to said second position, said control means provides simultaneous opening of the at least one opening in the head and flow of paste from the hollow body and onto the bristles of the brush, said body portion including at least one opening, the at least one opening in the body portion and the at least one opening in the head being disposed in substantially parallel planes and said at least one opening in the head being closed in the first position of the control means, said flow from the hollow body portion to the head being in a direction perpendicular to the plane of the at least one opening in the head and by way of the at least one opening in the body portion.

2. A brush as claimed in claim 1 in which the head comprises a base plate upstanding from which are said bristles, a plurality of said openings being formed in said base plate, the control member including a first end extent positioned below said base plate of the head and having a corresponding plurality of apertures therethrough for alignment with said openings in the head on sliding movement of the control member from its first position to its second position.

3. A brush as claimed in claim 2 in which the other end extent of the control member co-operates with the container in such a manner that said sliding movement thereof releases paste from the container which flows from the container through the aligned openings and apertures (40).

4. A brush as claimed in claim 1 in which the container comprises a sealed housing bounded by a diaphragm, movement of the control member from its first position to its second position displacing said diaphragm whereby paste is pumped from the housing to the head of the brush.

5. A brush as claimed in claim 1 in which said at least one opening comprises a plurality of openings, and in which the control member comprises an elongate slider extending between the container and the head, a passageway within the brush feeding from the container to a plurality of apertures formed in a first end extent of the slider positioned below the head, said apertures being aligned with the openings in the head with the control member in its second position.

6. A brush as claimed in claim 1 in which said at least one opening comprises a plurality of openings and in which the control member is hollow and incorporates therein a passageway feeding from the container to a plurality of apertures formed in a first end extent of the control member positioned below the head, said apertures being aligned with the openings in the head with the control member in its second position.

7. A brush as claimed in claim 1 in which the container comprises a handle of the brush, said handle being integral with the head of the brush.

8. A brush as claimed in claim 1 in which the control member includes an operating button projecting from the brush, movement of which effects said movement of the control member.

9. A brush as claimed in claim 1 in which the head is removable from the brush.

10. A brush as claimed in claim 1, in which the container comprises a handle of the brush, said handle being detachable from the brush.

11. A brush as claimed in claim 1, in which the container is incorporated in a handle of the brush, said handle being integral with the brush.

12. A brush as claimed in claim 1, in which the container is incorporated in a handle of the brush, said handle being detachable from the brush.

* * * * *